US009476316B2

(12) United States Patent
Hillier

(10) Patent No.: US 9,476,316 B2
(45) Date of Patent: Oct. 25, 2016

(54) CMC TURBINE ENGINE COMPONENT

(71) Applicant: ROLLS-ROYCE PLC, London (GB)

(72) Inventor: Steven Hillier, Manchester (GB)

(73) Assignee: ROLLS-ROYCE plc, London (GB)

( * ) Notice: Subject to any disclaimer, the term of this patent is extended or adjusted under 35 U.S.C. 154(b) by 424 days.

(21) Appl. No.: 14/196,746

(22) Filed: Mar. 4, 2014

(65) Prior Publication Data

US 2014/0255170 A1 Sep. 11, 2014

(30) Foreign Application Priority Data

Mar. 6, 2013 (GB) ..... 1303995.3

(51) Int. Cl.

| | |
|---|---|
| ***F01D 11/08*** | (2006.01) |
| ***F01D 9/02*** | (2006.01) |
| ***F01D 11/12*** | (2006.01) |
| ***F01D 9/04*** | (2006.01) |
| *F01D 5/28* | (2006.01) |
| *F01D 11/00* | (2006.01) |

(52) U.S. Cl.

CPC ..... *F01D 11/12* (2013.01); *F01D 5/284* (2013.01); *F01D 9/04* (2013.01); *F01D 9/041* (2013.01); *F01D 5/282* (2013.01); *F01D 11/005* (2013.01); *F05D 2240/11* (2013.01); *F05D 2240/80* (2013.01); *F05D 2300/6033* (2013.01)

(58) Field of Classification Search

CPC ..... F01D 5/284; F01D 5/282; F01D 11/005; F01D 11/006; F01D 11/008; F01D 11/12; F01D 11/122; F01D 11/125; F01D 11/127; F01D 9/04; F01D 9/041; F05D 2300/6033; F05D 2240/11; F05D 2240/80

USPC ..... 415/135, 138–139, 173.3, 173.4, 174.2, 415/214.1; 416/193 A

See application file for complete search history.

(56) References Cited

U.S. PATENT DOCUMENTS

| | | | | |
|---|---|---|---|---|
| 2006/0231586 | A1 | 10/2006 | Blanchard et al. | |
| 2010/0111678 | A1 | 5/2010 | Habarou et al. | |
| 2012/0247124 | A1* | 10/2012 | Shapiro | F01D 9/04 415/173.1 |

FOREIGN PATENT DOCUMENTS

| | | |
|---|---|---|
| EP | 0 751 104 A2 | 1/1997 |
| EP | 1 965 030 A2 | 9/2008 |

OTHER PUBLICATIONS

Search Report issued in British Patent Application No. GB1303995.3 dated Aug. 30, 2013.

* cited by examiner

*Primary Examiner* — Christopher Verdier
(74) *Attorney, Agent, or Firm* — Oliff PLC

(57) ABSTRACT

A component of a gas turbine engine is formed from a continuous fiber reinforced ceramic matrix composite (CMC). The component has a sealing portion which, in use, makes sealing contact with an adjacent component of the engine. The sealing portion comprises a recess formed in the CMC and filled with a finer grade ceramic relative to the surrounding CMC, a metal or an intermetallic.

11 Claims, 7 Drawing Sheets

CMC TURBINE ENGINE COMPONENT

FIELD OF THE INVENTION

The present invention relates to a component of a gas turbine engine, the component being formed from a continuous fibre reinforced ceramic matrix composite (CMC).

BACKGROUND OF THE INVENTION

The performance of gas turbine engines, whether measured in terms of efficiency or specific output, is improved by increasing the turbine gas temperature. It is therefore desirable to operate the turbines at the highest possible temperatures. For any engine cycle compression ratio or bypass ratio, increasing the turbine entry gas temperature produces more specific thrust (e.g. engine thrust per unit of air mass flow). However, as turbine entry temperatures increase, it is necessary to develop components and materials better able to withstand the increased temperatures.

This has led to the replacement of metallic components, such as shroud segments, with CMC components having higher temperature capabilities. To accommodate the change in material, however, adaptations to the components have been proposed. For example, EP 0751104 discloses a ceramic segment having an abradable seal which is suitable for use with nickel base turbine blades, and EP 1965030 discloses a hollow section ceramic seal segment. For improved strength and toughness, the CMC can be continuous fibre reinforced.

Gas turbine engine components often require sealing, e.g. to retain a back face air pressure, maintain cooling flows and protect specific fuel consumption (SFC). For example, FIG. 1 shows schematically a longitudinal cross-section though a seal segment 1 which, in use, is positioned radially adjacent shroudless aerofoil blades 2 of the rotor of the engine. A circumferential row of such seal segments forms a shroud ring for the rotor. Neighbouring segments can be sealed to each other by strip seals, which are metal strips located in slots formed in side faces of neighbouring segments. Dash-dotted line 3 in FIG. 1 indicates the line taken by such a strip seal from the front to the rear of the segment. The segments can be sealed to the outer casing 4 of the rotor via bird mouth seals 5 at front and rear races of the segments. Cooling air for the ring enters a space 6 formed between the segments and the casing.

The strip and bird mouth seals are suitable for use with metallic seal segments. In particular, such seals require the segments to have high tolerance surface finishes of the type that can be achieved with metallic components. However, a problem associated with continuous fibre reinforced CMCs is that they generally have a surface texture similar to a woven fabric, which is not a suitable sealing face. The CMC surface can be ground to a high tolerance, but porosity in the CMC can then reduce sealing efficiency.

SUMMARY OF THE INVENTION

It would be desirable to provide a continuous fibre reinforced CMC component having improved sealing capability.

Accordingly, in a first aspect the present invention provides a component of a gas turbine engine, the component being formed from a continuous fibre reinforced CMC;

wherein the component has a sealing portion which, in use, makes sealing contact with an adjacent component of the engine, the sealing portion comprising a recess formed in the CMC and filled with a finer grade ceramic relative to the surrounding CMC, a metal or an intermetallic.

Advantageously, the filler (whether a finer grade ceramic, metal or intermetallic) can provide the component with a reduced surface roughness and reduced porosity. Further, by providing the filler in the recess it can be embedded in the CMC, whereby the filler, which may be less damage tolerant than the CMC, can be protected on multiple sides by the CMC.

In a second aspect the present invention provides a gas turbine engine fitted with the component of the first aspect.

Optional features of the invention will now be set out. These are applicable singly or in any combination with any aspect of the invention.

Preferably the recess is filled with the finer grade ceramic. This may be a monolithic ceramic. Another option, however, is for the finer grade ceramic to be another CMC, e.g. a short-fibre or particulate reinforced CMC.

The finer grade ceramic may have substantially the same composition as the ceramic matrix of the CMC. In this way the chemical and mechanical compatibility can be improved. For example, the thermal expansion coefficients of the finer grade ceramic and the ceramic matrix of the CMC can be matched.

On the other hand, a metal or intermetallic filler may be adopted Such a filler may provide a more compatible surface for contact with the flexible seal than a ceramic filler can provide. However, the metal or intermetallic would generally need to be relatively thin to prevent excessive stresses and strains in the surrounding CMC. Also the metal or intermetallic should be able to withstand the operating temperature at the sealing portion.

The sealing contact between the component and the adjacent component can be effected by a flexible sealing member which conforms to the surface of the sealing portion. Thus the flexible sealing member can be an alternative to a strip seal or a bird mouth seal. For example, the sealing member can be a convolute seal such as a C-seal, a W-seal, an omega-seal or a bellow seal.

The component can be a seal segment for a shroud ring of a rotor of the engine, the seal segment being positioned, in use, radially adjacent the rotor. The adjacent component may be a casing of rotor. The recess can be a channel formed in a face of the segment, such as a back face distal from the rotor. For example, the channel may extend around the periphery of the face.

Alternatively, the component can be a nozzle guide vane. Such a vane may have an aerofoil body which extends between inner and outer endwall platforms, the recess being formed in one of the platforms. Indeed, a filled recess may be formed in each platform. The adjacent component may be a neighbouring endwall component (i.e. to front or rear of the platform, or it may be the platform of a next nozzle guide vane in a row of guide vanes).

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
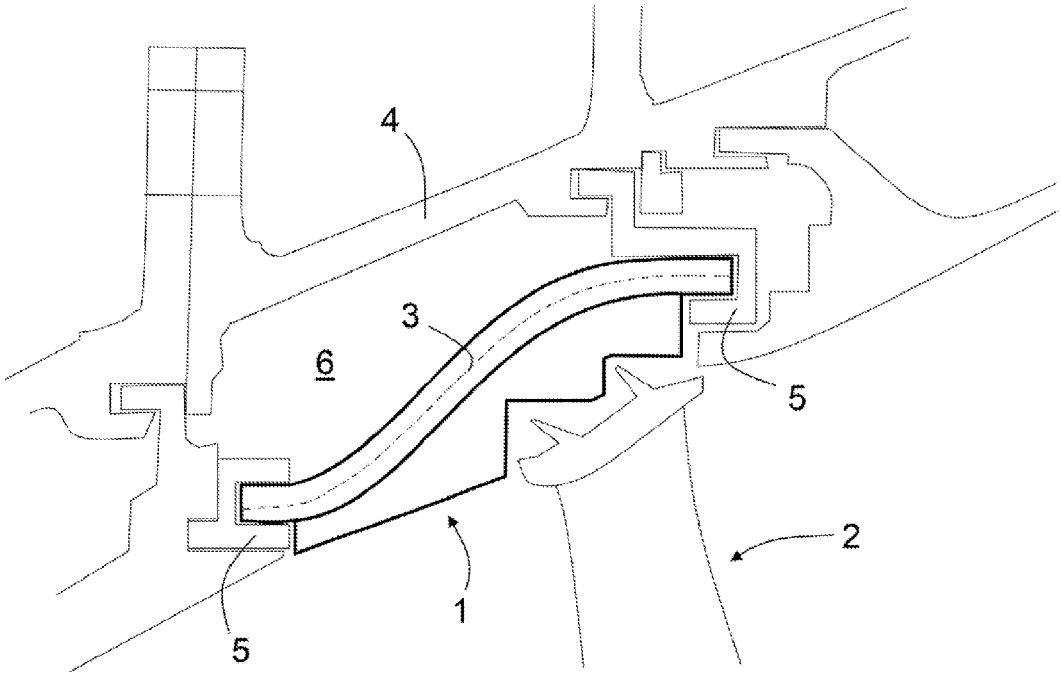
FIG. 1 shows schematically a longitudinal cross-section through a seal segment or a shroud ring of a rotor of the engine.
Figure 2:
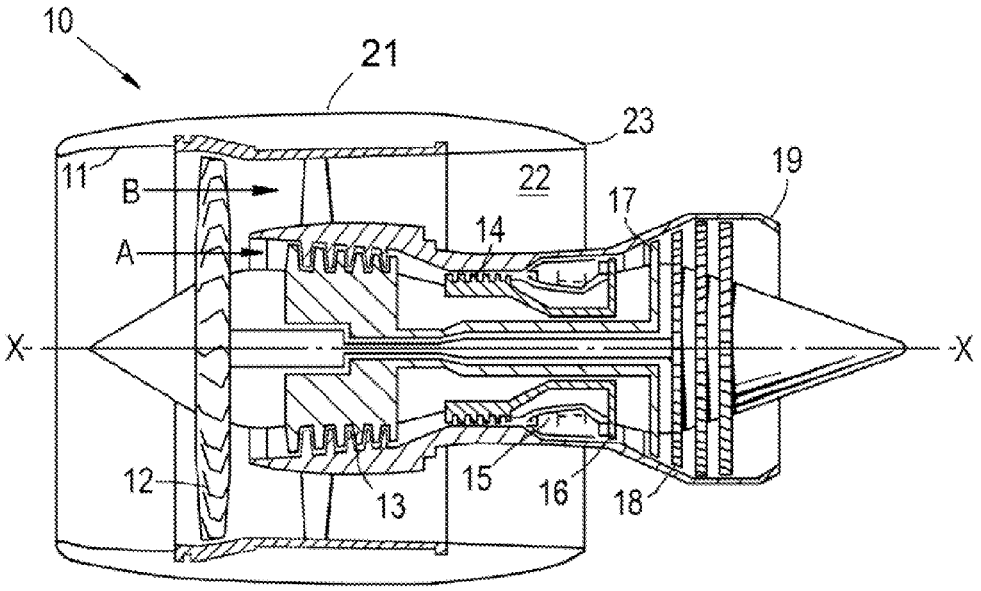
FIG. 2 shows schematically a longitudinal cross-section through a gas turbine engine.

With reference to FIG. 2, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The high pressure turbine 16 includes an annular array of radially extending, shroudless rotor aerofoil blades A shroud ring is positioned radially outwardly of the aerofoil blades. The shroud ring serves to define the radially outer extent of a short length of the gas passage through the high pressure turbine 16.

Figure 3:
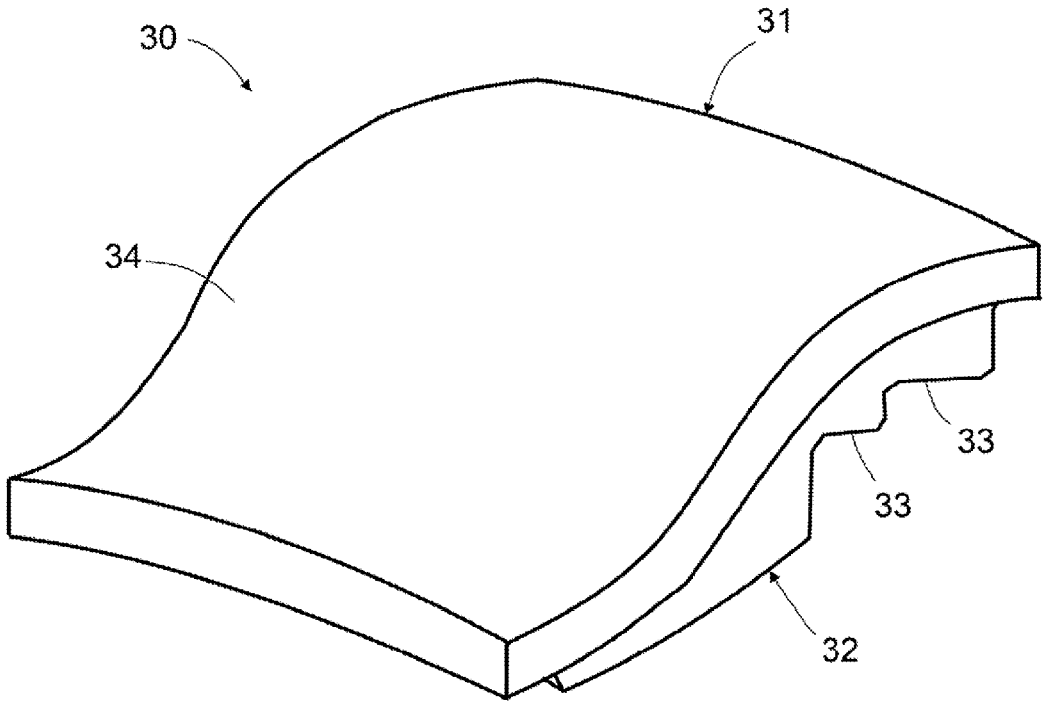
FIG. 3 show schematically an isometric view of a seal segment.

The turbine gases flowing over the radially inward facing surface of the shroud ring are at extremely high temperatures. Consequently, the shroud ring is formed from an annular row of continuous fibre reinforced CMC seal segments, which are capable of withstanding those temperatures whilst maintaining their structural integrity. FIG. 3 shows schematically an isometric view of one of the segments 30. The segment has a continuous fibre reinforced CMC main body 31 based on laid plys of reinforcing fibre. The gas-washed surface of the segment, however, may be formed by a separate ceramic layer 32 bonded to the main body and shaped (e.g. machined) to provide needed gas-washed surface features, such as steps 33 to match sealing fins projecting from the blade tips. Cooling air for the ring enters spaces formed between the segments and a casing for the rotor.

Instead of or in addition to sealing the edges of the segment (e.g. with strip seals and/or bird mouth seals), a flexible convolute seal (such as a C-seal, W-seal, omega-seal or bellow seal) is used on the back face 34 of the segment near to the edges. The seal conforms to the segment back surface, taking on the general shape of the back face. However, because the seal would not conform well to the surface roughness created by the plies of reinforcing fibre, and because a machined CMC surface would have surface porosity that would reduce the effectiveness of a seal, a finer grade ceramic is embedded in the back face to provide a sealing portion of the segment.

Figure 4:
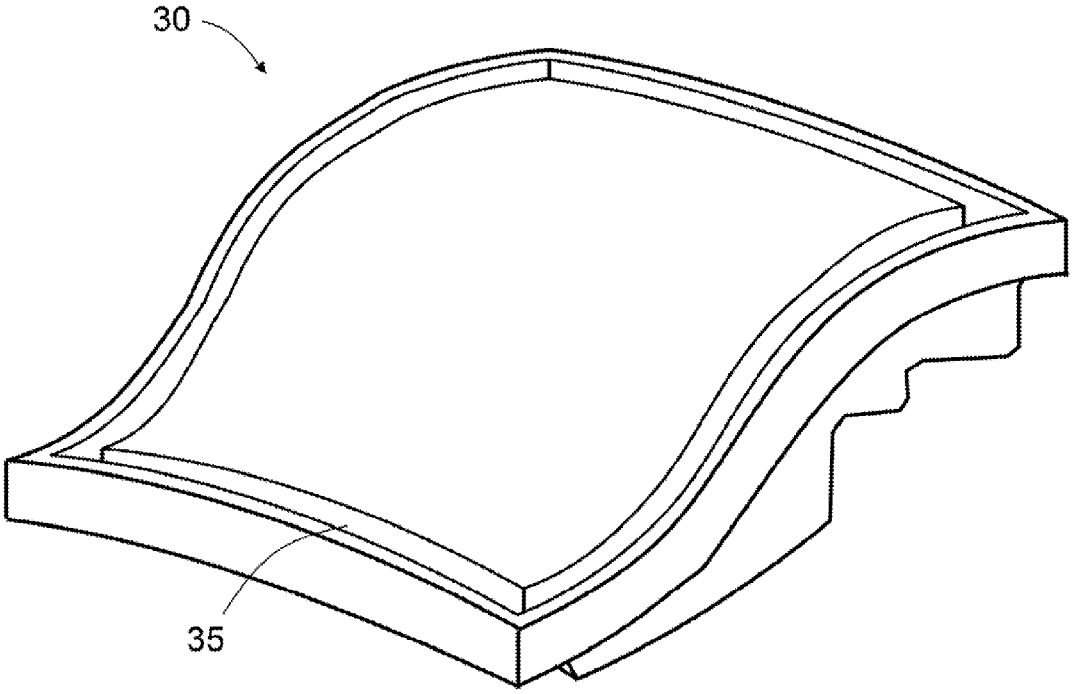
FIG. 4 repeats the isometric view of FIG. 3 and indicates the position of a channel of CMC material removed from the back face of the segment.
Figure 5:
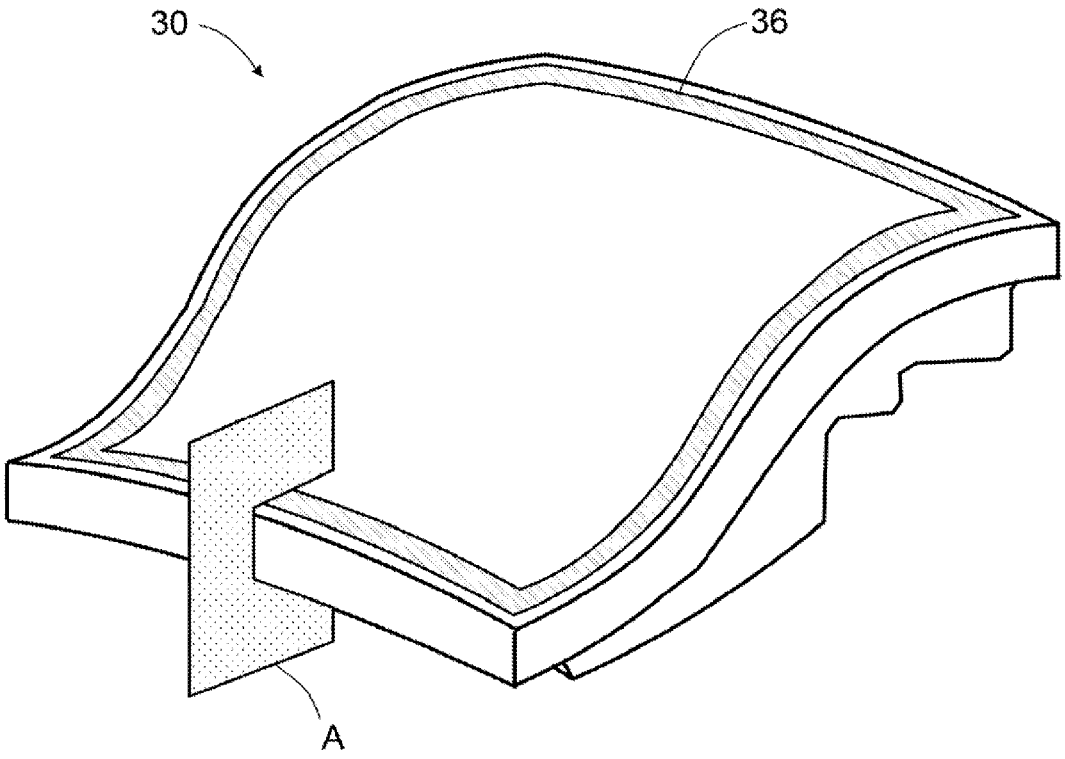
FIG. 5 repeats the isometric view of FIGS. 3 and 4 and shows the channel filled with a finer grade filler ceramic.

More particularly, and as shown in FIG. 4, a channel 35 of CMC material is removed from the back face 34 around the periphery of the main body 31 of the segment 30, e.g. by machining. As shown in FIG. 5, a finer grade (less coarse) filler ceramic 36, compatible with the parent CMC, is then embedded in the channel, e.g. by casting in situ, spraying in situ, or pre-casting and bonding in place with an adhesive, and is machined to provide a smooth, clean and low porosity outer surface on which to seat. Advantageously, the filler ceramic 36, which is less robust than the continuous fibre reinforced CMC, is protected on three sides by the channel, only the outer surface being exposed.

Figure 6:
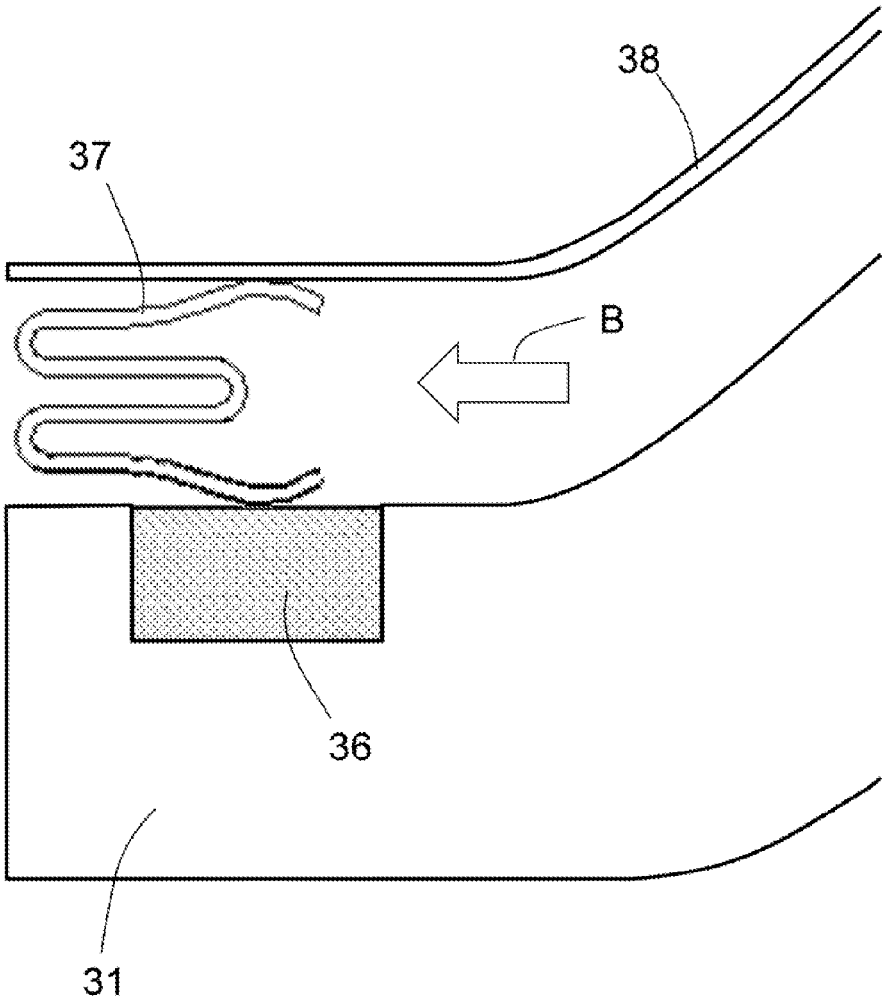
FIG. 6 shows schematically the seal segment on section A indicated on FIG. 5.

FIG. 6 shows schematically the segment on section A indicated on FIG. 5. A W-seal 37 seals between the smooth outer surface of the filler ceramic 36 and a typically metal component 38, which may be the rotor casing itself or an intermediate component. This seal helps to prevent high pressure cooling air (indicated by arrow B) in the space between the segment and the casing from escaping around the edges of the segment 30.

Figure 7:
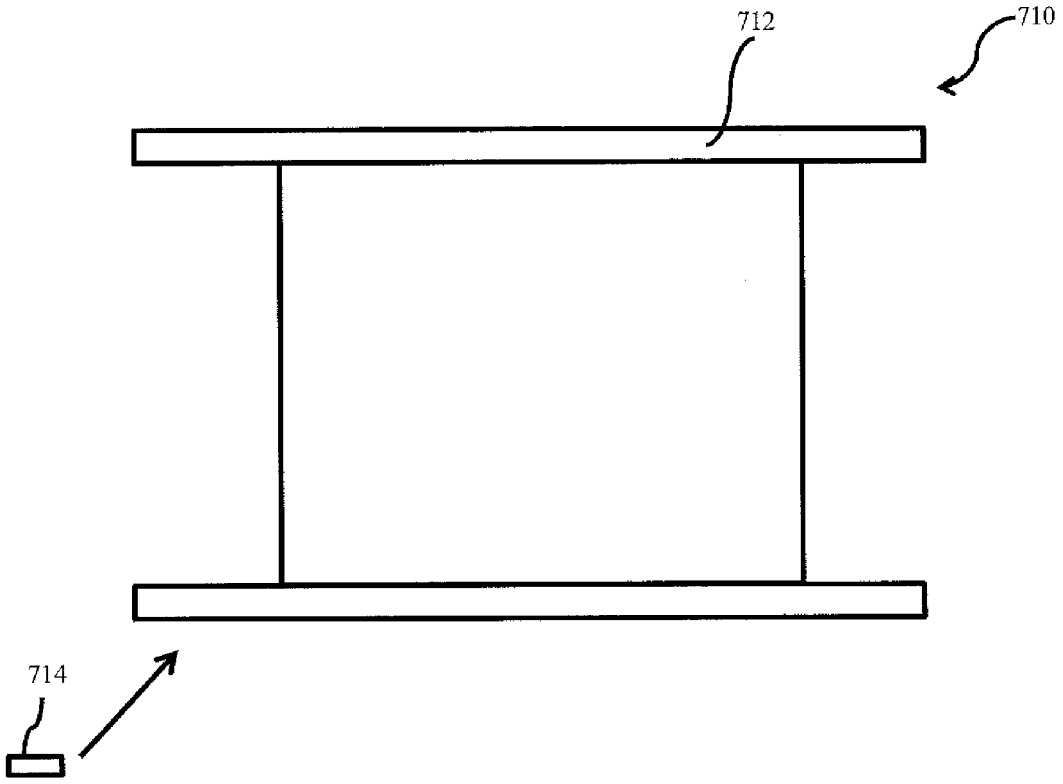
FIG. 7 shows a schematic view of a conventional nozzle guide vane.

While the invention has been described in conjunction with the exemplary embodiments described above, many equivalent modifications and variations will be apparent to those skilled in the art when given this disclosure. For example, as shown in FIG. 7, the continuous fibre reinforced CMC component having a recessed sealing portion 714 formed of finer grade ceramic may be another component of a gas turbine engine, such as nozzle guide vane 710, and in particular an endwall 712 of such a vane 710. In another example, the channel may be filled with a metal or an intermetallic rather than finer grade ceramic. A metal or intermetallic would tend to provide a more compatible surface for contact with the flexible seal, and can also be embedded by casting in situ, spraying in situ, or pre-casting and bonding. However, the metal or intermetallic would generally need to be relatively thin to prevent excessive stresses and strains in the surrounding CMC. Also the metal or intermetallic should be able to withstand the operating temperature at the seal location. Accordingly, the exemplary embodiments of the invention set forth above are considered to be illustrative and not limiting. Various changes to the described embodiments may be made without departing from the spirit and scope of the invention.

The invention claimed is:

1. A component of a gas turbine engine, the component being formed from a continuous fibre reinforced ceramic matrix composite (CMC);

wherein the component has a sealing portion which, in use, makes sealing contact with an adjacent component of the engine, the sealing portion comprising a recess formed in the CMC and filled with a finer grade ceramic relative to the surrounding CMC, a metal or an intermetallic wherein sealing contact between the component and the adjacent component is effected by a flexible sealing member which conforms to a surface of the sealing portion.

2. The component according to claim 1, wherein the finer grade ceramic is a monolithic ceramic.

3. The component according to claim 1, wherein the finer grade ceramic has substantially the same composition as the ceramic matrix of the CMC.

4. The component according to claim 1 which is a seal segment for a shroud ring of a rotor of the engine, the seal segment being positioned, in use, radially adjacent the rotor.

5. A seal segment according to claim 4, wherein the recess is a channel formed in a face of the segment.

6. The seal segment according to claim 5, wherein the channel extends around the periphery of the face.

7. The seal segment according to claim 5, wherein the face is a back face distal from the rotor.

8. The seal segment according to claim 4, wherein the adjacent component is a casing of the rotor.

9. The component according to claim 1 which is a nozzle guide vane.

10. A nozzle guide vane according to claim 9, wherein the vane has an aerofoil body which extends between inner and outer endwall platforms, the recess being formed in one of the platforms.

11. A gas turbine engine fitted with the component of claim 1.

* * * * *